US012053045B2

(12) United States Patent
Dogukaya et al.

(10) Patent No.: US 12,053,045 B2
(45) Date of Patent: Aug. 6, 2024

(54) RATCHET DIAL MECHANISM FOR HELMET

(71) Applicant: C.E.S. Ileri Kompozit Ve Savunma Teknolojileri Sanayi Ve Ticaret Anonim Sirketi, Ankara (AR)

(72) Inventors: Çetin Dogukaya, Ankara (AR); Selami Soylu, Ankara (AR); Orhan Yesilgül, Ankara (AR); Jale Selin Sarifakioglu, Ankara (AR)

( * ) Notice: Subject to any disclaimer, the term of this patent is extended or adjusted under 35 U.S.C. 154(b) by 134 days.

(21) Appl. No.: 17/759,937

(22) PCT Filed: Sep. 24, 2021

(86) PCT No.: PCT/TR2021/050975
§ 371 (c)(1),
(2) Date: Aug. 2, 2022

(87) PCT Pub. No.: WO2023/048661
PCT Pub. Date: Mar. 30, 2023

(65) Prior Publication Data
US 2023/0337778 A1 Oct. 26, 2023

(51) Int. Cl.
*A42B 3/14* (2006.01)
*A42B 3/08* (2006.01)

(52) U.S. Cl.
CPC ..... *A42B 3/145* (2013.01); *A42B 3/08* (2013.01); *Y10T 24/2187* (2015.01)

(58) Field of Classification Search
CPC . A42B 3/145; Y10T 24/2187; Y10T 24/2724; Y10T 24/2183; Y10T 24/3724; Y10T 24/37; A43C 11/165; A43C 11/16; A43C 7/00
See application file for complete search history.

(56) References Cited

U.S. PATENT DOCUMENTS

| | | | | |
|---|---|---|---|---|
| 4,741,115 | A * | 5/1988 | Pozzobon | A43B 3/34 36/117.7 |
| 6,708,376 | B1 | 3/2004 | Landry | |
| 8,015,625 | B2 | 9/2011 | Grim et al. | |
| 8,370,967 | B2 | 2/2013 | Chen | |
| 8,684,295 | B2 * | 4/2014 | Taketsuna | H02G 11/02 242/385.4 |
| 9,913,016 | B2 * | 3/2018 | Shin | H04R 1/1033 |
| 2003/0093882 | A1 * | 5/2003 | Gorza | A43C 11/165 24/68 SK |

(Continued)

FOREIGN PATENT DOCUMENTS

EP 2614737 A1 7/2013

OTHER PUBLICATIONS

International Search Report and Written Opinion of the International Searching Authorityfor corresponding PCT/TR2021/050975, dated May 31, 2022.

*Primary Examiner* — Robert Sandy
*Assistant Examiner* — Michael S Lee
(74) *Attorney, Agent, or Firm* — Phil IP Law Inc.; Narek Zohrabyan; Karen 'Kirk' Galoyan

(57) ABSTRACT

A ratchet dial mechanism used on ballistic protective personal equipment and ballistic protective personal helmets, which enables the chin straps to be adjusted by tightening and loosening so that the helmet fits snugly on the user's head with precision and decreases the manufacturing cost and time due to fewer parts needed for assembly.

3 Claims, 3 Drawing Sheets

(56) References Cited

U.S. PATENT DOCUMENTS

| | | | | |
|---|---|---|---|---|
| 2008/0109947 | A1 | 5/2008 | Dubois | |
| 2011/0167543 | A1* | 7/2011 | Kovacevich | F16G 11/12 2/417 |
| 2011/0284676 | A1* | 11/2011 | Taketsuna | H02G 11/02 242/378.4 |
| 2012/0153065 | A1* | 6/2012 | Fischer | B65H 75/4431 242/379 |
| 2015/0382095 | A1* | 12/2015 | Shin | B65H 75/4431 242/385.4 |
| 2020/0073130 | A1 | 3/2020 | Wang et al. | |
| 2021/0245991 | A1* | 8/2021 | Johnson | B65H 75/4492 |
| 2022/0202127 | A1* | 6/2022 | Lu | A42B 3/145 |
| 2023/0180878 | A1* | 6/2023 | Robbins | A42B 3/145 2/418 |

* cited by examiner

RATCHET DIAL MECHANISM FOR HELMET

TECHNICAL FIELD

The invention relates to dial mechanisms for personal protective equipment, and more specifically the chin straps used in ballistic personal protective helmets.

The invention particularly relates to a dial mechanism with three gears with lace around gearwheels to provide increased retention, stability, and better adjustability on the wearer's head during use.

BACKGROUND

The current applications contain many examples of gear fit and retention systems. Gear fit and retention systems intend to keep the product on the specific body part during use, maintain fit and comfort while in use, and allow the user to release the gear when desired. The dial mechanisms, made with different materials, sizes, and shapes, are applied to various products such as sneakers, snow boots, sports equipment, medical equipment, etc. These products mainly wrap and support different body parts such as the head, feet, knees, waist, and wrists.

The other most commonly applied technique requires an additional attachment part for the assembly. The invention comprises of a gearwheel, a lace wrapped around the gearwheel, a body that the gearwheel fits into, a lock that ties up or releases the lace, and attachment parts. Two ends of the lace are fixed with a knot to the inner side of the gearwheel and the lace is wrapped around the gearwheel. The lace is released through holes on opposite sides of the gearwheel. Assembly parts on the lace provide a connection to a chin strap. A clockwise turn of a lock piece wraps up the lace inside the gear and lets the user tension a product like a chin strap. On the other hand, pulling out the lock piece allows the user to unwrap the lace to release the product. Limitations of this mechanism make it harder to release and tie up the lace due to the use of a single gearwheel. The single gear system can only wind up as much of the lace as the diameter of the gearwheel itself on one turn. Also, the attachment part at the bottom of the body and assembly parts on the lace cause extra craftsmanship requirements and labor hours due to additional parts come with the similar product in the market. For all the reasons above, current applications of the mechanism can be improved upon.

According to literature research, U.S. Pat. No. 8,015,625B2 discloses an example of this type of mechanism applied to the adjustment of a bicycle helmet fit. The invention mentions an adjustment mechanism, that includes first and second retention members (for example, plastic straps) moving relative to each other, enabling the size of a helmet to be adjusted. The adjustment mechanism comprises a gearwheel that is connected to at least one of the retention members and can rotate in two directions to move at least one of the retention elements relative to the other.

U.S. Pat. No. 6,708,376B1 is another example of this technique to be examined, describing a method for adjustment of the length of a strap. In the invention, an adjustment mechanism consists of a strap with first and second overlapping parts and the pinion wheel that rotates between teeth inside the groove arranged in the first and second overlapping parts of said strap.

The document numbered U.S. Pat. No. 8,370,967B2 can be shown as another example of the technique. the document relates to an adjustable headband for a helmet. The invention mentions an adjustable headband for a helmet that comprises a base, a band, the adjusting wheel, a dial, and a cover.

The adjustment mechanisms mentioned in the above documents enable the helmet to be adjusted according to the users head by means of a single gearwheel. For this reason, these adjustment mechanisms do not solve the problems experienced in the current technical field.

As a result, the existence of the above problems and the inadequacy of the existing solutions made it necessary to make an improvement in the relevant technical field.

PURPOSE OF THE INVENTION

The invention relates to a ratchet dial mechanism for helmet chin straps, eliminates the disadvantages mentioned above, and brings new advantages to the related technical field. The purpose of the invention is to present a ratchet dial mechanism that allows the chin straps to be fully fixed and adjusted to the users head utilizing a three-gearwheel system and a lace wrapped around the gearwheels.

The invention introduces a ratchet dial mechanism, which consists of three gearwheels, (two small gearwheels, and the large wheel in the middle of the two small gearwheels) and provides tightening or loosening of the lace by wrapping it on the below part of the small gearwheels by rotating a connected lock on the large gearwheel.

Another aim of the invention is to facilitate the collection and oscillation of the lace by wrapping the two ends of the lace on two small gearwheels.

The invention provides a faster loosening or tightening of the lace on each turn of the lock of the ratchet dial mechanism.

The invention provides a simplified design reducing the craftsmanship required and costs in production by eliminating the need for extra assembly parts of the manufacturer by the added design of mounting holes on the body.

To fulfill all the purposes stated above and which may arise from the detailed description, the invention is a ratchet dial mechanism that is located in the adjustment mechanism on the ballistic personal protective equipment and provides the adjustment of the chin straps of the ballistic helmets. It includes,

- a groove for three gears on the body, fixed to the chin strap,
- a large gear that can be rotated clockwise at the center of the groove,
- first and second pinion wheels that are turned by the large gear in the middle of the two wheels inside the groove,
- the lace that is knotted to the first pinion wheel at one end and to the second pinion wheel at the other end by passing through holes on both sides of the body and gathered by wrapping on the lower part of the first pinion wheel and the lower part of the second pinion wheel by the rotational movement of the large gear to ensure the tightening of the chin strap,
- the cover with internal gear that fits on the body,
- a lock that moves clockwise and in and out in the internal gear, starts the rotational movement of the large gear by making a clockwise rotation in its down position, and ensures the release of the lace and the loosening of the chin strap by cutting the contact with the large gear in the out position.

The figures below and the detailed descriptions of the figures explain the structural and characteristic features of the invention and all its advantages. For this reason, the invention should be evaluated by examining these figures and detailed explanations.

DESCRIPTION OF THE REFERRED PARTS

Figure 1:
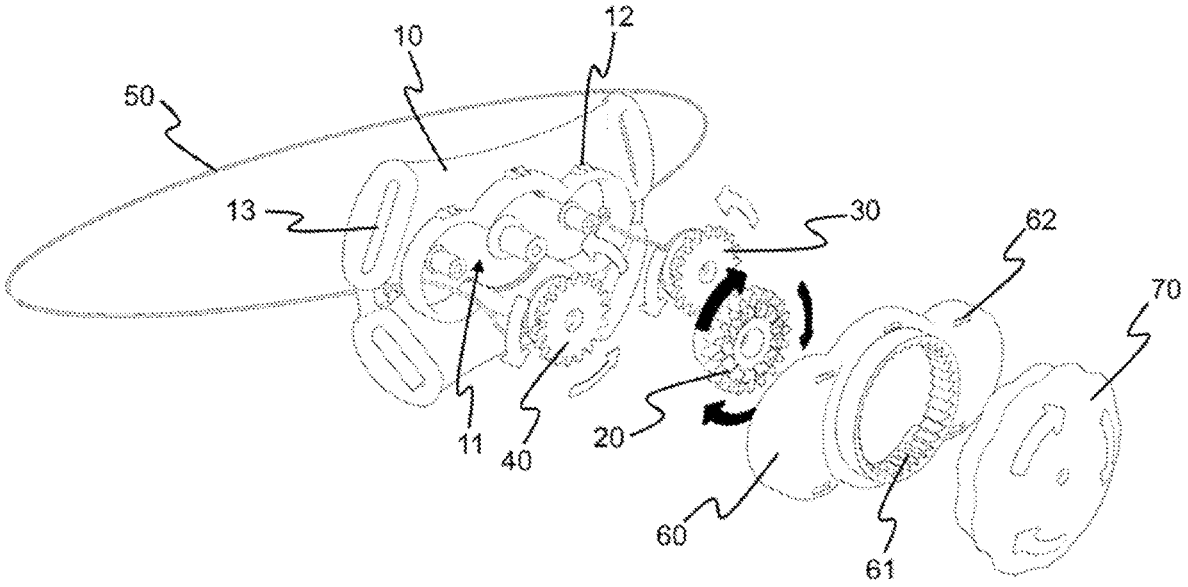
FIG. 1: The exploded view of the ratchet dial mechanism, which is the subject of the invention.
Figure 2A:
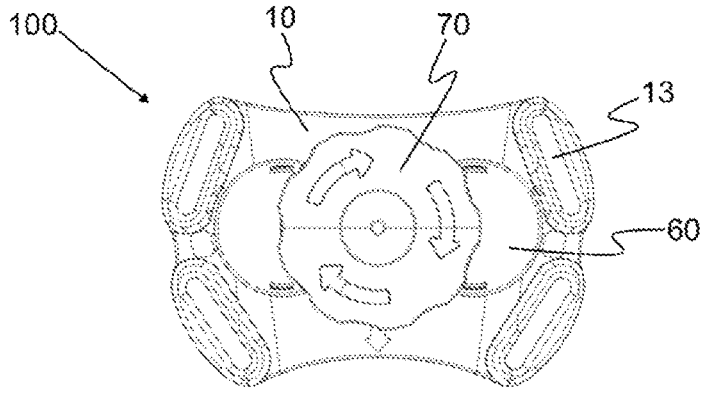
FIG. 2*a*: The top view of the ratchet dial mechanism which is the subject of the invention.
Figure 2B:
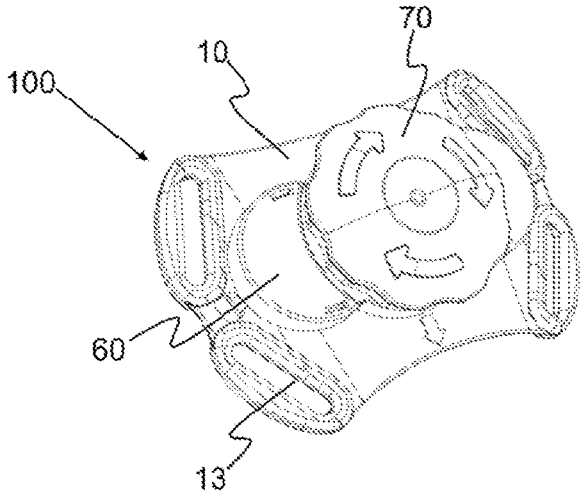
FIG. 2*b*: The perspective view of the ratchet dial mechanism, which is the subject of the invention.
Figure 2C:
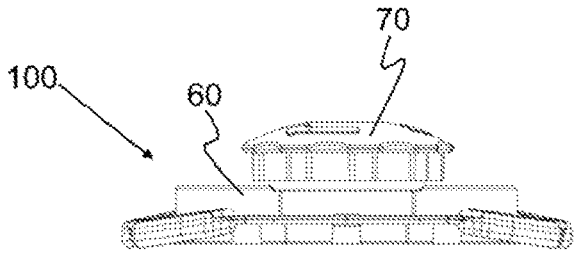
FIG. 2*c*: The front view of the ratchet dial mechanism, which is the subject of the invention.
Figure 2D:
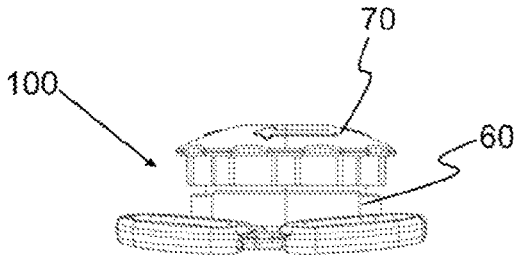
FIG. 2*d*: The side view of the ratchet dial mechanism, which is the subject of the invention.

10. Body
11. Groove
12. Male snap-fit component
13. Mounting hole
20. Large gear
30. First pinion wheel
40. Second pinion wheel
50. Lace
60. Cover
61. Internal gear
62. Female snap-fit component
70. Lock
100. Ratchet dial mechanism
200. Chin strap
300. Ballistic helmet

DETAILED DESCRIPTION OF THE INVENTION

This detailed explanation, the preferred alternatives of the ratchet dial mechanism (100) subject to the invention explains only for a better comprehending of the subject and without any limiting effect.

FIG. 1 represents the exploded view of the ratchet dial mechanism (100) subject to the invention. The ratchet dial mechanism (100) in its most basic form consists of; a body (10), a large wheel (20) that rotates clockwise in the center of the body (10), the first pinion wheel (30), and the second pinion wheel (40) associated with both sides of the large gear (20) within the body (10) making rotational movement. The lace (50) tightens by wrapping around the lower part of the first pinion wheel (30) and the second pinion wheel (40), a cover (60) closed on the body (10), a lock (70) that provides the drive of the rotational movement and at the same time ensures that the lace (50) is released by breaking the contact with the large gear (20) when the lock (70) is pulled out.

There is a groove (11) for three gears (11) at the center of the body (10), which forms the main structure of the ratchet dial mechanism (100). The mentioned groove holds a large gear (20) in its center groove (11). The large gear (20) makes a clockwise rotation movement. A first pinion wheel (30) and a second pinion wheel (40) connect to both sides of the large gear (20) in the mentioned groove (11), in contact with the large gear (20). The first pinion wheel (30) and the second pinion wheel (40) rotate counterclockwise utilizing force transmitted from the large gear (20).

Two ends of lace (50) go through the holes located on opposite sides of the body (10). One end of the mentioned lace (50) connects to the first pinion wheel (30) with a knot and the other end to the second pinion wheel (40) with a knot. The rotational movement of the first pinion wheel (30) and the second pinion wheel (40) tightens the lace (50) by wrapping it around the lower part of the first pinion wheel (30) and the second pinion wheel (40). This movement also results in adjustment of the chin strap (200) on which the ratchet dial mechanism (100) is placed.

A cover (60) is closed on the body (10) that protects the ratchet dial mechanism (100) from external conditions. In the center of the cover (60), there is an internal gear (61) that guides the lock (70). The cover (60) and the body (10) come together with a snap-fit mechanism. There are female snap-fit components (62) on the mentioned cover (60) and there are male snap-fit components (12) on the body (10).

A lock (70) fits inside the internal gear (61) on the cover (60). The mentioned lock (70) rotates clockwise and moves in and out in the internal gear (61) for user engagement. The mentioned lock (70) interfaces with the large gear (20) in its in position within the internal gear (61). When the user rotates the lock (70) clockwise, the lock (70) transmits the rotational movement to the large gear (20). Thus, the rotational movement of the large gear (20) transmits equally to the first pinion wheel (30) and the second pinion wheel (40) and pulls the lace (50) around the first pinion wheel (30) and the second pinion wheel (40). As a result, the lace (50) tightens the chin strap (200) and users can adjust the ballistic helmet (300) according to their head shape and size. At the same time, when the user pulls the lock (70) outwards through the internal gear (61), contact of the lock (70) with the large gear (20) is cut off and the chin strap (200) is loosened by the release of the lace (50).

The ratchet dial mechanism (100), which is the subject of the invention, seen in FIGS. 2*a*, 2*b*, 2*c*, and 2*d*, is made ready for use by being fixed to the chin straps (200) through the mounting holes (13) located on each corner of the body (10).

Figure 3:
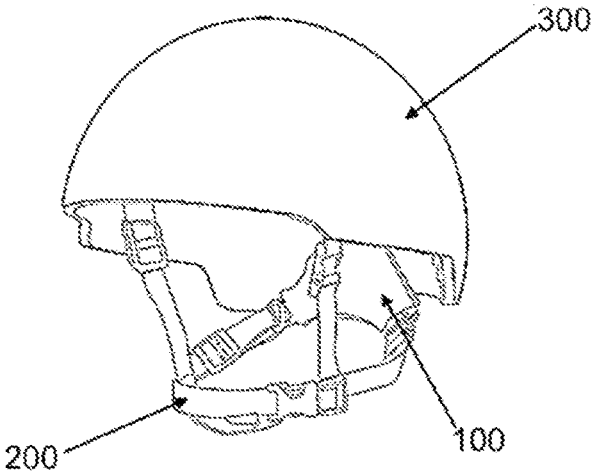
FIG. 3: The representative illustration of the ratchet dial mechanism, which is the subject of the invention, on the helmet.

The ratchet dial mechanism (100) is preferably used on ballistic helmets (300), as seen in FIG. 3, and can also be applied on ballistic protective personal equipment that needs adjustment by tightening and loosening in alternative embodiments of the invention.

Figure 4A:
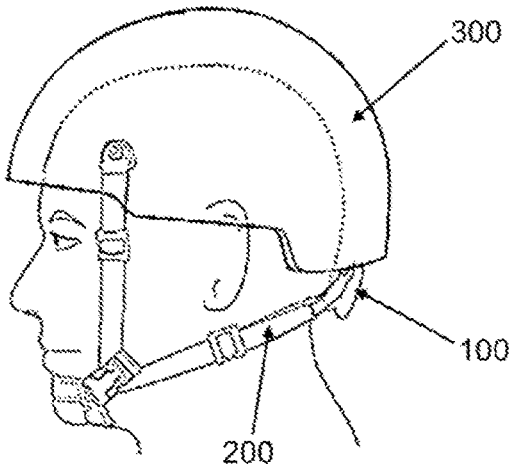
FIG. 4*a*: The side view illustration of the ratchet dial mechanism, which is the subject of the invention, on a helmet worn by the user.
Figure 4B:
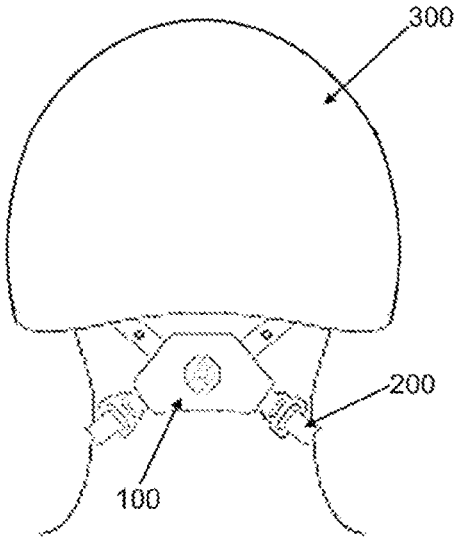
FIG. 4*b*: The back view of the ratchet dial mechanism, which is the subject of the invention, on a helmet worn by the user.

The use of the ratchet dial mechanism (100) subject to the invention is as follows;

To tighten the chin strap (200), the lock (70) rotates clockwise when it is in its down position and moves the large gear (20). With the rotational movement of the large gear (20), the first pinion wheel (30) and a second pinion wheel (40) rotate, and wrap the lace (50) around the lower part of the first pinion wheel (30) and the second pinion wheel (40). As a result, the user tightens the chin strap (200). Thus, as it is seen in FIGS. 4*a* and 4*b*, the ballistic helmet (300) is ensured to fit on the users head and can be adjusted according to the head shape and size.

To loosen the chin strap (200), the user pulls out the lock (70) and releases the lace (50) by breaking the contact between the lock (70) and the large gear (20). Thus, the chin strap (200) loosens by releasing the lace (50).

The invention claimed is:

1. A ratchet dial mechanism used on protective personal equipment and ballistic protective personal helmets, which enables the adjustment of chin straps, the ratchet dial mechanism comprising:

a groove for a large gear, a first pinion wheel and a second pinion wheel on a body that is fixed to the chin straps, wherein the large gear can be turned clockwise at a center of the groove, wherein the first pinion wheel and second pinion wheel can be rotated by the large gear in a middle of first pinion wheel and second pinion wheel inside the groove, lace that is knotted to the first pinion wheel at one end and to the second pinion wheel at the other end by passing through holes on both sides of the body and gathered by wrapping on the lower part of the first pinion wheel and the second pinion wheel by rotational movement of the large gear to ensure the tightening of the chin straps, a cover with an internal gear that fits on the body, a lock that moves clockwise, inwards and outwards within the internal gear, when the lock is in its inwards position the lock is in contact with the large gear and clockwise rotation of the lock starts rotational movement of the large ear when the lock is in its outwards position contact with the lock and large gear is cut ensuring release of the lace and loosening of the chin straps.

2. The ratchet dial mechanism of claim 1, wherein it includes a male snap-fit component that extends on the horizontal axis on the said body and enables the cover to be fixed on the body by engaging a female snap-fit component on the cover.

3. The ratchet dial mechanism of claim 1, wherein the body comprises four corners, mounting holes located on each corner of said body and enabling the body to be fixed to the chin straps.

* * * * *